US007278177B1

(12) United States Patent
Duffie

(10) Patent No.: US 7,278,177 B1
(45) Date of Patent: Oct. 9, 2007

(54) EMERGENCY EYE WASH STATION

(76) Inventor: Ken Duffie, 121 Highland St., Middleboro, MA (US) 02346

( * ) Notice: Subject to any disclaimer, the term of this patent is extended or adjusted under 35 U.S.C. 154(b) by 0 days.

(21) Appl. No.: 11/413,486

(22) Filed: Apr. 28, 2006

Related U.S. Application Data

(60) Provisional application No. 60/675,586, filed on Apr. 29, 2005.

(51) Int. Cl.
*A61H 33/00* (2006.01)
*A61H 33/04* (2006.01)

(52) U.S. Cl. ..... 4/620; 604/294

(58) Field of Classification Search ..... 4/619, 4/620, 624–626; 604/294, 295, 300–302
See application file for complete search history.

(56) References Cited

U.S. PATENT DOCUMENTS 4,012,798 A 3/1977 Liautaud
4,363,146 A 12/1982 Liautaud
4,881,283 A * 11/1989 Liautaud ..... 4/620
5,008,963 A 4/1991 Stein
5,171,307 A 12/1992 Sanning
5,216,765 A 6/1993 Paterson et al.
5,381,567 A 1/1995 Tanner et al.
5,566,406 A 10/1996 Demeny et al.
D438,983 S 3/2001 Stein
6,280,408 B1 8/2001 Sipin
6,296,626 B1 10/2001 Stein

OTHER PUBLICATIONS

Encon Retractable Tray Eye Washes and Cart, p. 580, LSS, date unknown.
Encon Safety Products, Aquarion eyewash station, http://www.enconsafety.com/agarion/, date unknown.
Bradley On-Site Portable Eye Wash, p. 579, LSS, date unknown.
Fend-All Porta Stream I Personal Eye Wash Station, p. 582, LSS, date unknown.
Fend-All Pure Flow 1000 Elergency Eye Wash Station, p. 578, LSS, date unknown.
Fend-All Gravity-Feed Porta Stream Eyesaline Eye Wash Station p. 577 LSS, date unknown.
Haws Gravity-Feed Eye Wash p. 577 LSS, date unknown.
Speakman Cartridge Eyewash, Flyer, date unknown.
Speakman Portable Eye Washes. p. 581, LSS, date unknown.

* cited by examiner

*Primary Examiner*—Huyen Le
(74) *Attorney, Agent, or Firm*—John P. McGonagle

(57) ABSTRACT

A self-contained eye wash station for dispensing flushing fluid having two rigid rectangular containers and a base unit supporting the rigid containers at a fixed height. Each container has an integral fluid/air chamber and is filled with flushing fluid. The containers nest and lock into recesses of the base unit. A spray nozzle is connected to the fluid/air chamber of each rigid container via a flexible tube. The base unit has a pivoting manifold which has an "open" or "closed" position. The spray nozzles lock into snap fixtures on the manifold. Flexible caps cover the spray nozzles. Each fluid/air chamber has a vent opening covered by a flexible cap. The base unit also has a fluid reservoir and a fluid drain. An optional fluid collection container for waste fluid may be provided with the eye wash station.

7 Claims, 7 Drawing Sheets

FIG. 10A
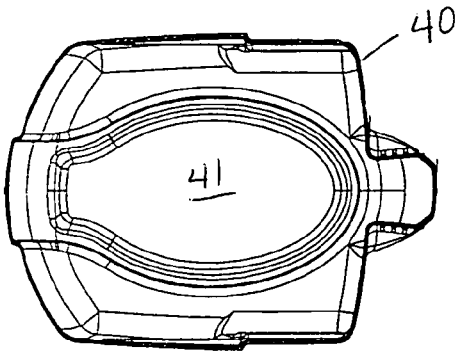
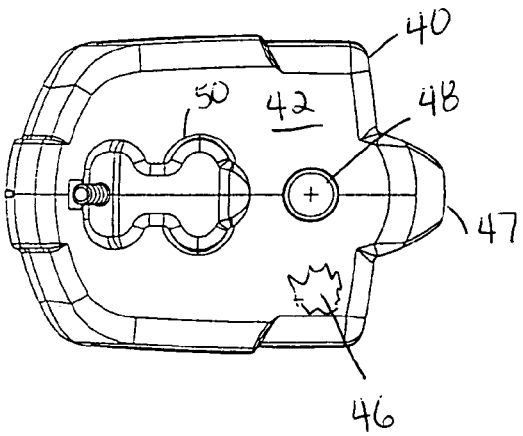
FIG. 10B
FIG. 11A
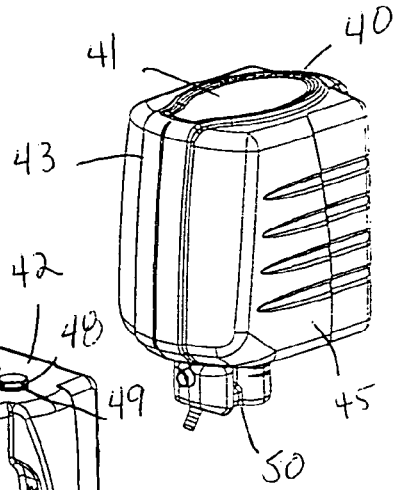
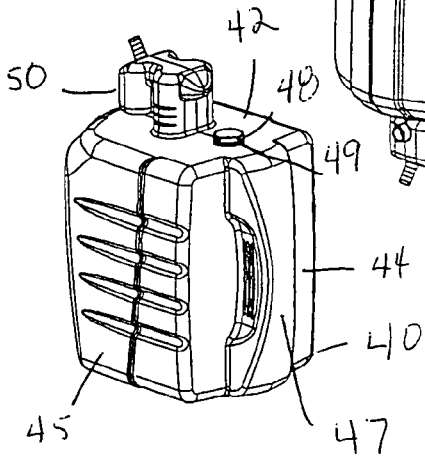
FIG. 11B

EMERGENCY EYE WASH STATION

CROSS-REFERENCE TO RELATED APPLICATIONS

Applicant claims the priority benefits of U.S. Provisional Patent Application No. 60/675,586, filed Apr. 29, 2005.

BACKGROUND OF THE INVENTION

This invention relates to emergency fountain wash receptacles, and in particular, to a portable, self-contained, emergency eye wash station.

There is an ongoing need to protect the health and safety of workers. For this reason, it is common to find eye wash fountains at industrial work stations, laboratories, and other locations where workers are exposed to gaseous fumes, liquids or solid materials which can irritate or injure a worker's eyes. The Occupational Safety and Health Administration (OSHA) has made eye wash fountains mandatory for particular industrial work stations.

Some prior art devices have employed eye wash fountains providing sprays of water from regular plant plumbing connections. Other prior art devices are self-contained, gravity-fed, and independent of any plumbing connections. Such eye wash fountains typically contain a reservoir of wash fluid spaced above two opposed liquid spray nozzles. Upon activating the fluid flow, the wash fluid from the reservoir is fed solely by gravity to the nozzles to cause a gravity-induced spray of wash fluid from the nozzles.

The American National Standards Institute (ANSI) has promulgated standards for portable eye wash fountains relating to flushing periods and the rate of flow of wash fluid. These standards dictate that portable eye wash fountains should deliver no less than 0.4 gallons per minute of eye wash fluid in a 6 inch spray for a time period of 15 minutes.

Prior art portable eye wash stations typically contain a tank of fluid which is elevated with respect to flow outlet configured to spray a fluid stream into the user's eyes. A station tank must be refilled after a station has been used or every six months as a periodic maintenance, whichever is sooner. Because of the difficulties in refilling a tank without spillage or without introducing contaminants, prior art wash stations use bags of liquids to refill the tank.

A drawback of the gravity-fed eye wash fountains of the type described above is that they contain fluid significantly in excess of the amount required for actual flushing to meet ANSI standards. The reason for this is that the rate of flow of wash fluid from the gravity-fed eye wash fountains of the prior art decreases over time. The fluid pressure at an eye wash spray nozzle is a function of fluid head at the inlet to the nozzle. As fluid is used and the tank is gradually emptied, the fluid height within the tank, the consequent hydraulic head at the spray nozzle inlet, and thereby both liquid flow rate through the spray nozzle and height of a spray pattern from the spray nozzle gradually diminish. therefore, in order to ensure meeting ANSI standards, prior art tanks contain 16 gallons of fluid.

SUMMARY OF THE INVENTION

The present invention provides a self-contained eye wash station for dispensing flushing fluid and is comprised two rigid rectangular containers and a base unit supporting the rigid containers at a fixed height. Each container has an integral fluid/air chamber and is filled with flushing fluid. The containers nest and lock into recesses of the base unit.

A spray nozzle is connected to the fluid/air chamber of each rigid container via a flexible tube. The base unit has a pivoting manifold which has an "open" or "closed" position. The spray nozzles lock into snap fixtures on the manifold. Flexible caps cover the spray nozzles. Each fluid/air chamber has a vent opening covered by a flexible cap. The base unit also has a fluid reservoir and a fluid drain.

The eye wash station of the present invention is designed to meet ANSI standards while only requiring 7 gallons of liquid. The liquid is contained in two, rigid, 3½ gallon containers. This ensures substantial cost savings over time and also provides ease of replacement due to the low volume and low weight of the individual containers. The present invention provides a vacuum chamber which regulates the flow providing a consistent and steady 6 inch spray for 15 minutes regardless of the liquid levels in the two rigid containers. Because the containers are rigid, a vacuum is created at the top of the container interior thereby holding the liquid up so that the liquid does not overflow the vacuum chamber.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 10A is a bottom view of the reservoir container.

FIG. 10B is a top view thereof.

FIG. 11A is a perspective view of the reservoir container.

FIG. 11B is a perspective view of the reservoir container inverted.

DETAILED DESCRIPTION OF INVENTION

Figure 1:
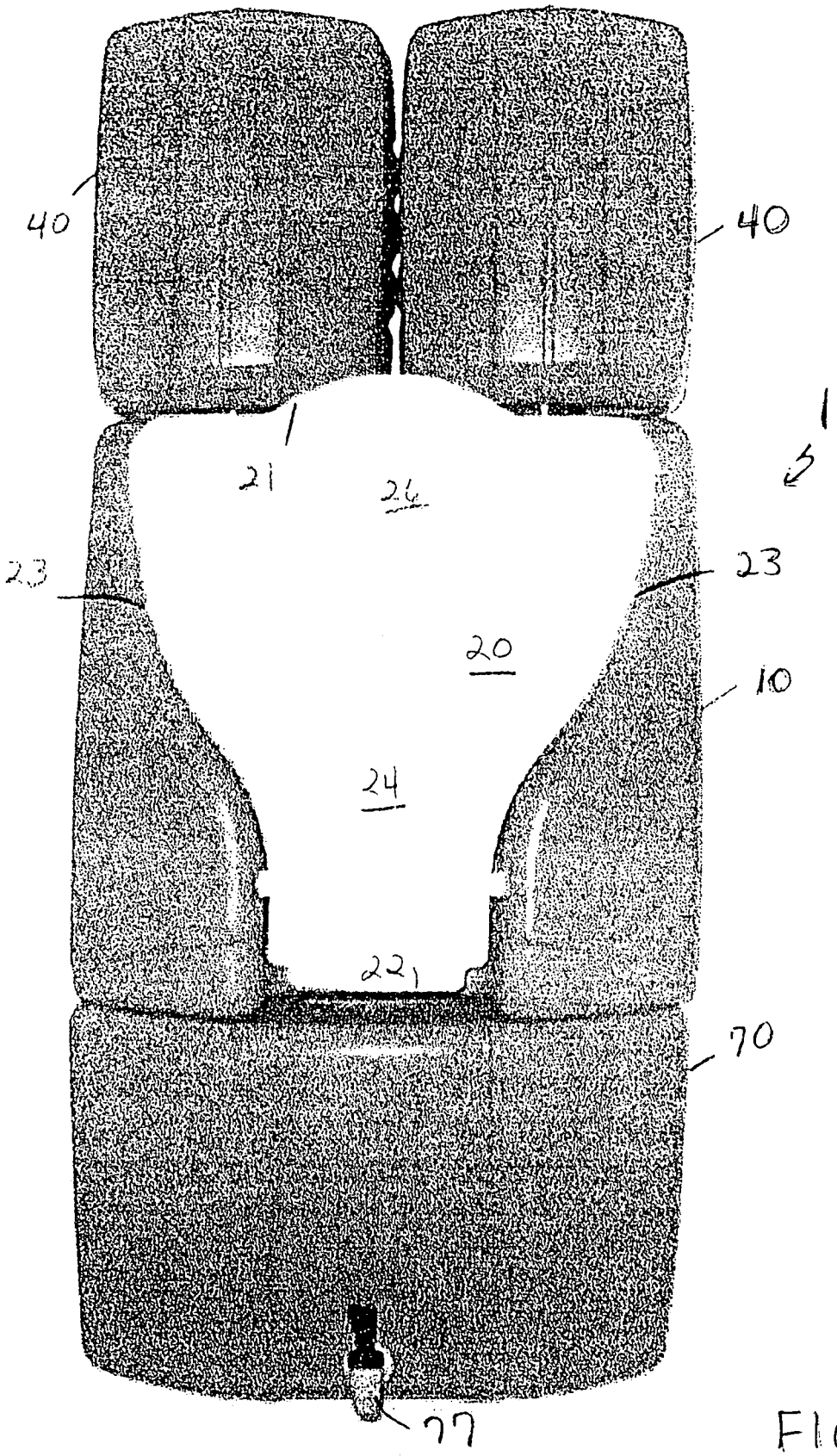
FIG. 1 is a front view of an eye wash station constructed according to the principles of the invention and having the manifold in a closed position.
Figure 2:
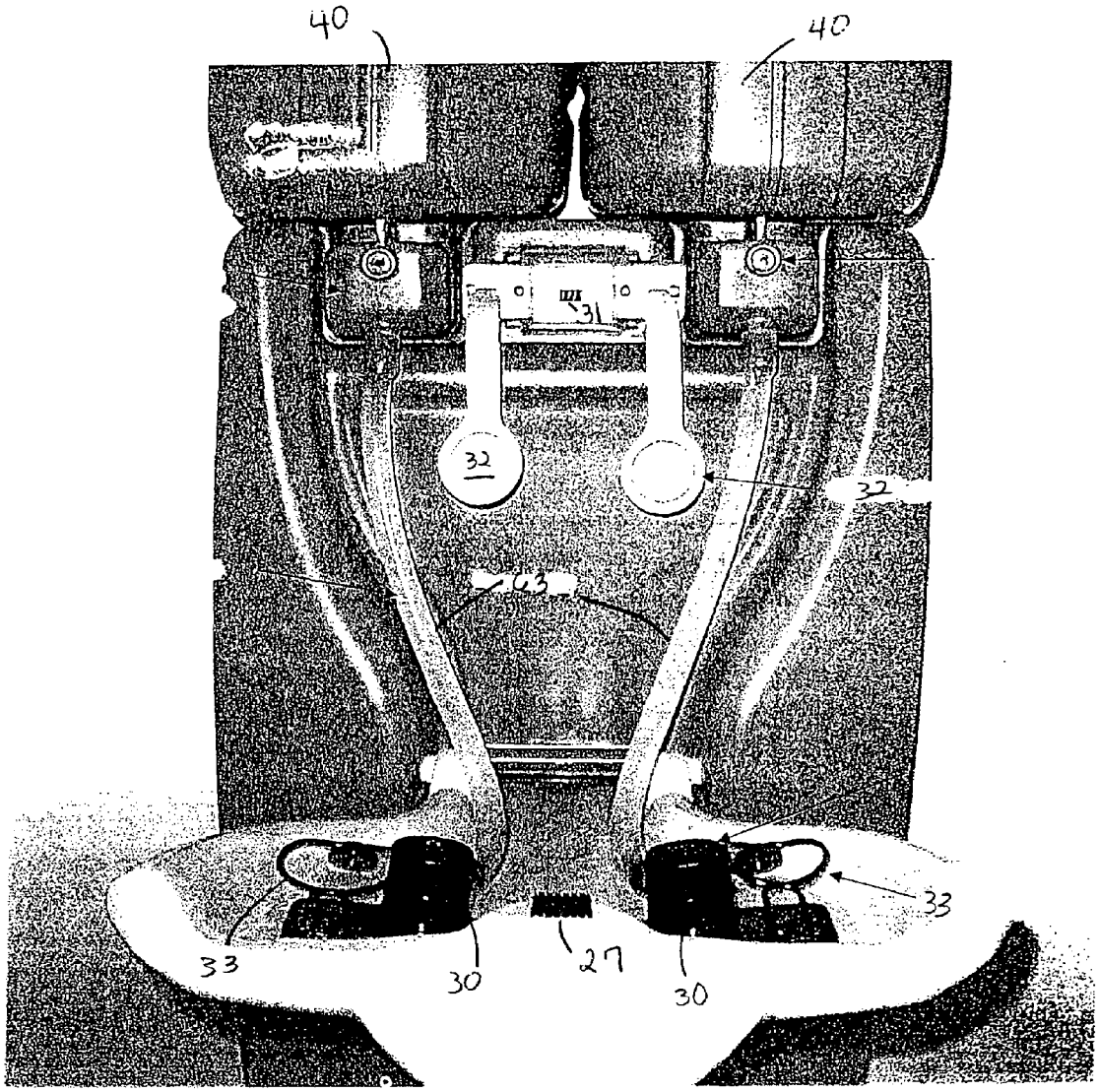
FIG. 2 is a front view of the station with the manifold in an open position.
Figure 3:
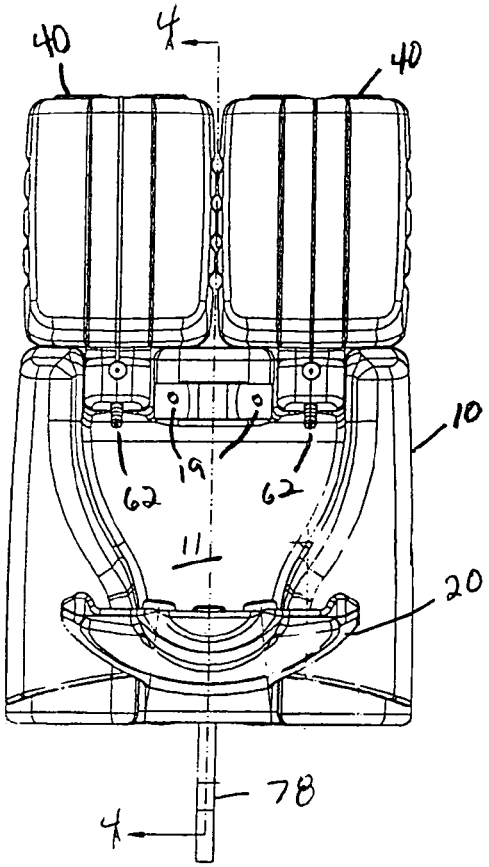
FIG. 3 is a front view of the eye wash station base unit with the manifold in an open position.
Figure 4:
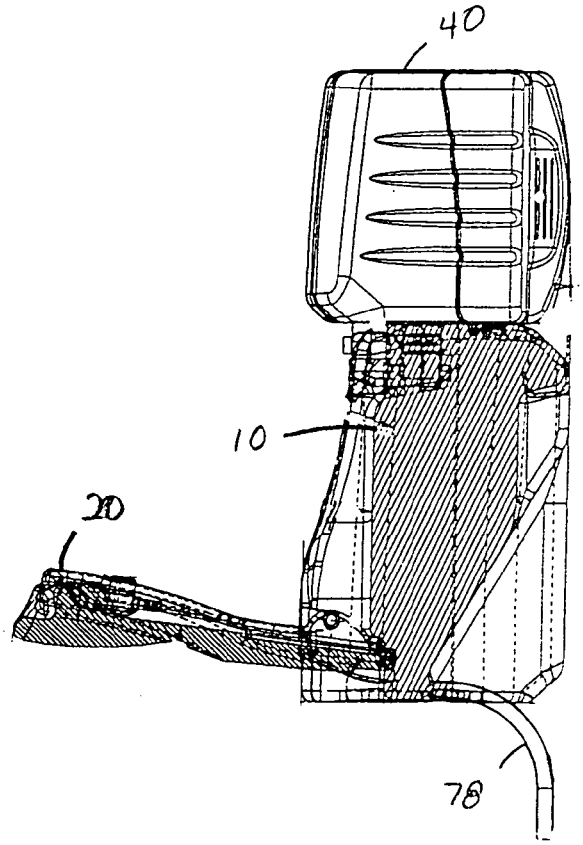
FIG. 4 is a side view along the line 4-4 in FIG. 3.
Figure 7:
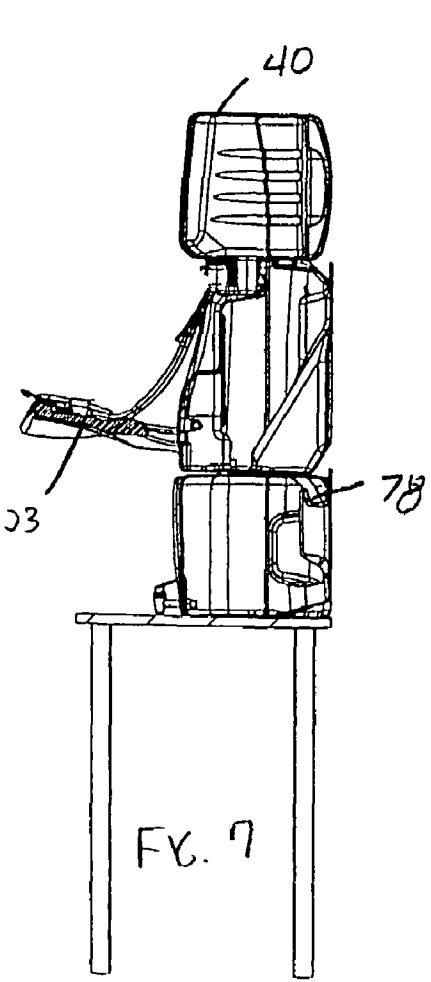
FIG. 7 is a side view along the line 7-7 in FIG. 5.
Figure 6:
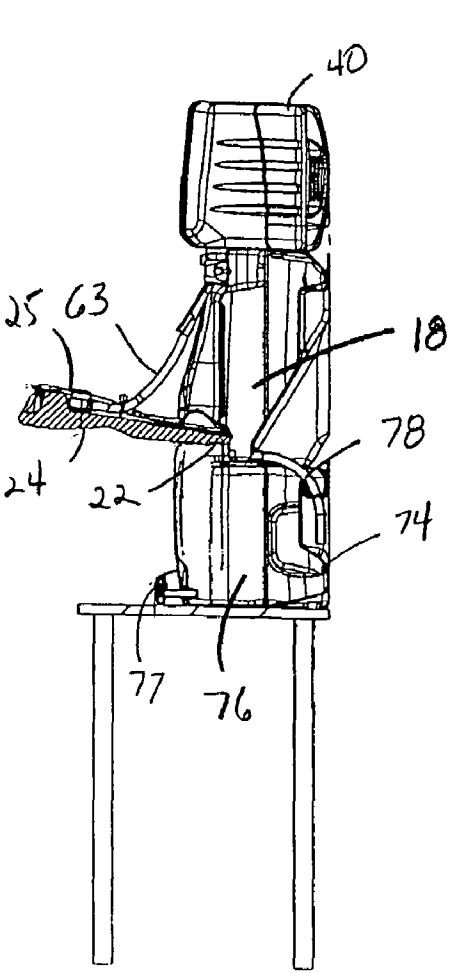
FIG. 6 is a side view along the line 6-6 in FIG. 5.
Figure 5:
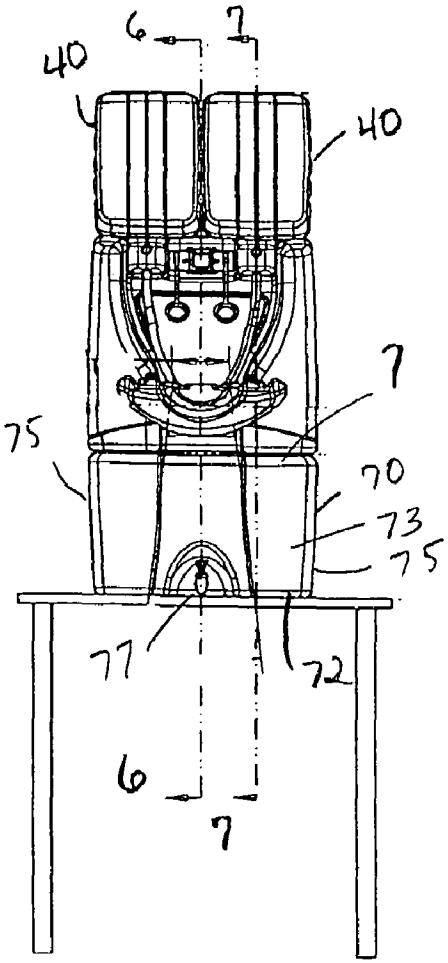
FIG. 5 is a front view of the eye station.
Figure 8:
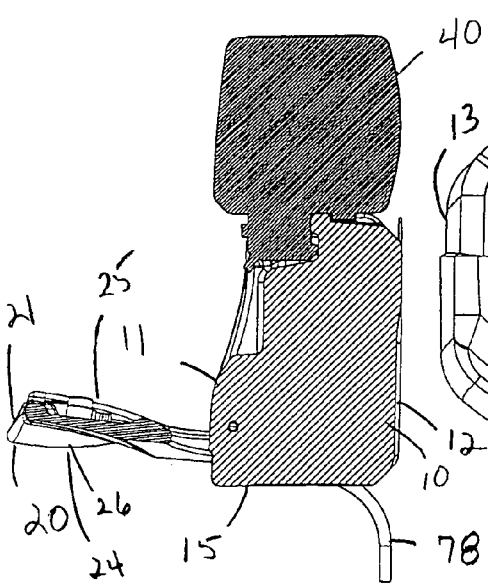
FIG. 8 is a side view of the station base unit with reservoir container on top.
Figure 9:
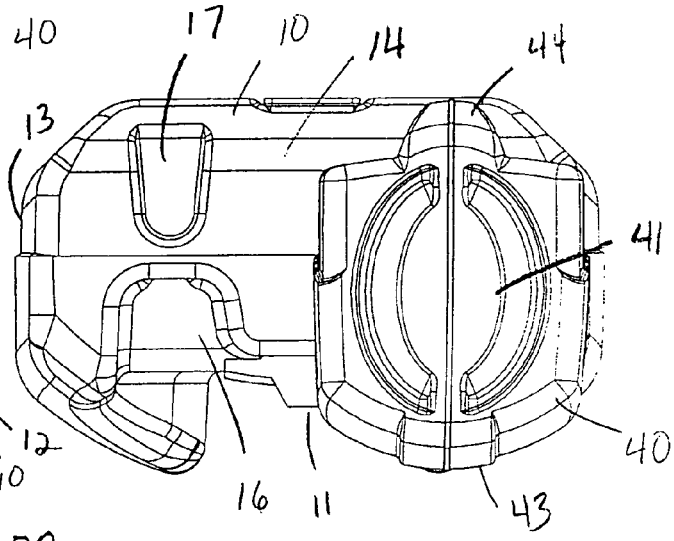
FIG. 9 is a top view of the base unit with one reservoir container.
Figure 12:
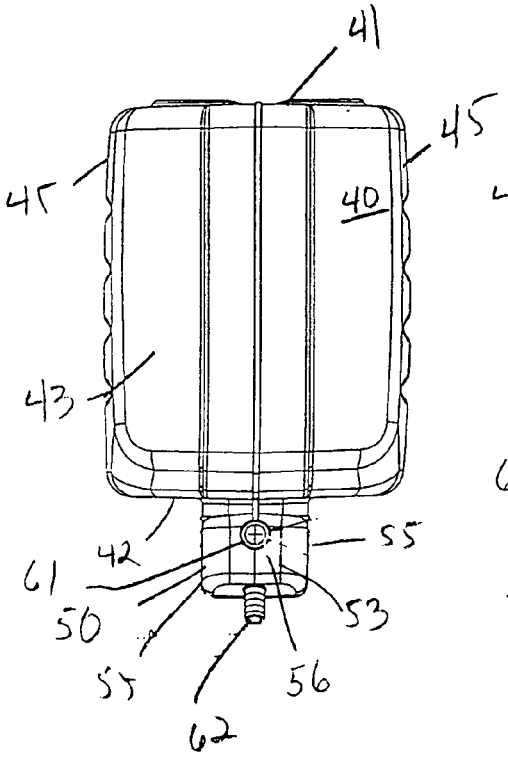
FIG. 12 is a front view of the reservoir container.
Figure 13:
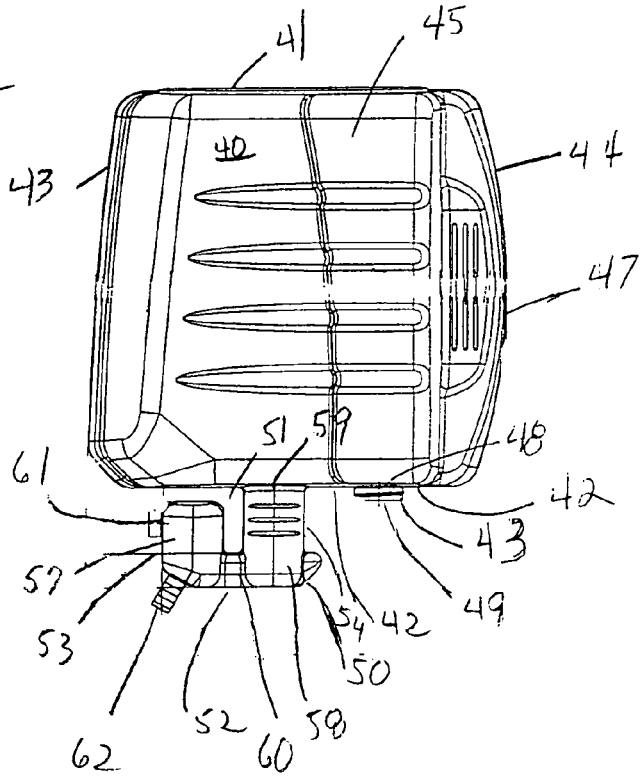
FIG. 13 is a side view of the reservoir container.

Referring to the drawings in detail wherein like elements are indicated by like numerals, there is shown an eye wash station 1 constructed according to the principles of the present invention. The eye wash station 1 is comprised of a base unit 10, two reservoir containers 40 holding flushing fluid, and a collection container 70 for waste fluid. The base unit 10 has a front 11, rear 12, two opposite sides 13, a top 14 and a bottom 15, said front, rear, sides, top and bottom defining a base unit interior 18. The base unit top 14 has two front apertures 16 formed therein, said front apertures opening onto the base unit front 11, said front apertures being positioned off-center toward each of the base unit sides 13. The base unit top 14 has two additional secondary apertures 17, each being positioned behind a front aperture 16 toward the base unit rear 12. Each reservoir container 40 sits in a secondary aperture 17.

The base unit front 11 has a pivoting manifold 20 attached thereto. The manifold 20 has a top 21, a bottom 22 pivotally connected to said base unit front 11, two opposite sides 23, an exterior surface 24 and an interior surface 25. The manifold interior surface 25 is defined as that surface facing the base unit front 11 when the manifold 20 is in a closed position. The manifold top 21 has a protruding portion 26 curved outwardly past the exterior surface 24, said curved portion 26 forming a gripping means for pivoting the manifold 20 from a closed position against the base unit front 11 to an open position wherein a surface plane of the manifold 20 is nearly perpendicular with a vertical plane of the base unit front 11. Beneath the manifold curved portion 26 a fastener 27 is fixedly attached to the manifold interior surface 25 along a manifold central axis 28 extending from the manifold top 21 to manifold bottom 22. Beneath the fastener 27 a fluid waste channel 29 is formed along the manifold interior surface 25 along the central axis 28 to the manifold bottom 22. The manifold waste channel 29 is adapted to engage a base unit front opening 19 for draining used fluid into the base unit interior 18. The manifold interior surface 25 also has two spray nozzles 30 attached thereto, one on each side of the central axis 28 approximately vertically level with the fastener 27.

The base unit front 11 has a fastener 31 fixedly attached adjacent the base unit top 14 between the front apertures 16 said fastener 31 adapted for releasable engagement with the manifold interior surface fastener 27. The base unit front 11 also has two nozzle covers 32 attached thereto adjacent the base unit top 14 between the front apertures 16, one cover being attached on each side of the fastener 31. The nozzle covers are adapted for releasable engagement with the spray nozzles 30. When the manifold 20 is in the closed position, the nozzle covers 32 are engaged with the spray nozzles 30. When the manifold 20 is pivoted into the open position, the nozzle covers 32 are disengaged from the spray nozzles 30.

Each reservoir container 40 is rigid and has a top 41, a bottom 42, a front 43, a rear 44, and two opposite sides 45, said top, bottom, front, rear and sides defining a reservoir container interior 46. Each reservoir container rear 44 has a vertical handle 47 formed or attached thereon. The reservoir container bottom 42 has a refill opening 48 formed therein near to the reservoir container rear 44, said refill opening being releasably sealable with a plug or cap 49.

Each reservoir container bottom 42 has a vacuum chamber 50 attached thereto. Each reservoir container bottom 42 rests on the base unit top 14 with the vacuum chamber 50 fitted into the base unit front aperture 16. Each vacuum chamber 50 has a top 51, a bottom 52, a front 53, a rear 54, and two opposite sides 55, said top, bottom, front, rear and sides defining a vacuum chamber interior 56. Each vacuum chamber 50 is formed into two separate compartments, a forward compartment 57 and a rear compartment 58.

The vacuum chamber rear compartment 58 is engaged with the reservoir container interior 46 through a second reservoir container bottom opening 59, said second opening 59 being in fluid engagement with the vacuum chamber rear compartment through the top 51 of the vacuum chamber rear compartment 58. The vacuum chamber forward compartment 57 and rear compartment 58 are in fluid engagement through a fluid engagement tube 60 located in the vacuum chamber interior 56 adjacent the vacuum chamber bottom 52. The vacuum chamber forward compartment 57 has a vent opening 61 formed on the vacuum chamber front 53 near to the vacuum chamber top 51. The forward compartment 57 has a fluid opening 62 at the junction of the vacuum chamber front 53 and bottom 52.

The fluid opening 62 is in fluid engagement with a spray nozzle 30 by means of an interconnecting silicon tube 63. The manifold interior surface 25 has two vent covers 33 adapted for releasable engagement with the vacuum chamber vent openings 61 and attached to manifold points adjacent to a spray nozzle near to a manifold side 23.

In operation, the eye wash station manifold 20 is normally in a closed position. The nozzle covers 32 are engaged with the spray nozzles 30. The vent covers 33 are engaged with the reservoir container vacuum chamber vent openings 61. In an emergency requiring use of the eye wash station 1, the manifold 20 is pulled into an open position by a user grasping the manifold top protruding portion 26 and pulling it outward from the base unit front 11, causing the manifold to pivot out and downward about the manifold bottom 22. As the manifold 20 is opened, the vent covers 33 are pulled off the vacuum chamber vent openings 61 and the nozzle covers 32 are pulled off the spray nozzles 30. Fluid passes from the reservoir container interiors 46, through the vacuum chamber rear compartment 58, into the vacuum chamber forward compartment 57, through the silicon tubes 63 and through the spray nozzles 30 resulting in a six inch spray of fluid emanating upward from each of the spray nozzles 30. The used fluid then is captured by the manifold fluid waste channel 29 flowing to the manifold bottom 22 into the base unit front opening 19 into the base unit interior 18.

The combination of reservoir container rigidity and integral vacuum chamber 50 controls the flow of fluid from the reservoir container. As the fluid level drops in the vacuum chamber 50, a vacuum in the rigid reservoir container 40 is created. Atmospheric pressure overcomes the created vacuum by air entering the vacuum chamber vent opening 61, thereby maintaining a consistent volume and pressure at the spray nozzles.

An optional fluid collection container 70 for waste fluid may be provided with the eye wash station 1. The collection container has a top 71, bottom 72, front 73, rear 74 and two opposite sides 75, said top, bottom, front, rear and opposite sides defining a collection container interior 76. The collection container 70 has a spigot 77 in fluid engagement with the collection container interior 76, said spigot being positioned in the collection container front 73 adjacent the collection container bottom 72. The eye wash station base unit bottom 15 is adapted to sit on the collection container top 71. A fluid tube 78 interconnects the base unit interior 18 with the collection container interior 76.

It is understood that the above-described embodiment is merely illustrative of the application. Other embodiments may be readily devised by those skilled in the art which will embody the principles of the invention and fall within the spirit and scope thereof.

I claim:

1. A self-contained eye wash station for dispensing a flushing fluid, comprising:

a base unit having a front, rear, two opposite sides, a top and a bottom, said front, rear, sides, top and bottom defining a base unit interior, said base unit top having two front apertures formed therein, said front apertures opening onto the base unit front, said front apertures being positioned off-center toward each of the base unit sides, said base unit top having two secondary apertures, each secondary aperture being positioned behind a front aperture toward the base unit rear;

two rigid rectangular containers each container having a top, a bottom, a front, a rear, and two opposite sides, said top bottom, front, rear and sides defining a reservoir container interior, each said container adapted to being filled with said flushing fluid, wherein said rigid container nests and lock into a said base unit secondary recess, wherein said base unit supports said rigid containers at a fixed height;

a spray nozzle connected to each rigid container via a flexible tube; and a pivoting manifold having a top, a bottom pivotally connected to said base unit front, two opposite sides, an exterior surface and an interior surface, said pivoting manifold having an "open" and a "closed" position, said manifold interior surface being defined as that surface facing the base unit front when the manifold is in a closed position, wherein said spray nozzles lock into snap fixtures on the manifold;

wherein each reservoir container bottom has a vacuum chamber attached thereto, each reservoir container bottom resting on the base unit top with the vacuum chamber fitted into a base unit front aperture, each said vacuum chamber having a top, a bottom, a front, a rear, and two opposite sides, said top, bottom, front, rear and sides defining a vacuum chamber interior, each vacuum chamber being formed into two separate compartments, a forward compartment and a rear compartment, each said vacuum chamber rear compartment being engaged with the reservoir container interior through a second reservoir container bottom opening, said second opening being in fluid engagement with the vacuum chamber rear compartment through the top of the vacuum chamber rear compartment, said vacuum chamber forward compartment and rear compartment being in fluid engagement through a fluid engagement tube located in the vacuum chamber interior adjacent the vacuum chamber bottom, said vacuum chamber forward compartment having a vent opening formed on the vacuum chamber front near to the vacuum chamber top, said forward compartment having a fluid opening at a junction of the vacuum chamber front and bottom;

wherein the vacuum chamber forward compartment fluid opening is in fluid engagement with a said spray nozzle by means of an interconnecting tube;

wherein the manifold interior surface has two vent covers adapted for releasable engagement with the vacuum chamber forward compartment vent openings and attached to manifold points adjacent to a spray nozzle near to a manifold side.

2. A self-contained eye wash station as recited in claim 1, wherein:

said manifold top has a protruding portion curved outwardly past the exterior surface, said curved portion forming a gripping means for pivoting the manifold from a closed position against the base unit front to an open position wherein a surface plane of the manifold is nearly perpendicular with a vertical plane of the base unit front.

3. A self-contained eye wash station as recited in claim 2, further comprising:

a manifold interior surface fastener beneath the manifold curved portion fixedly attached to the manifold interior surface along a manifold central axis extending from the manifold top to manifold bottom;

a fluid waste channel beneath the fastener, said fluid waste channel formed along the manifold interior surface along the manifold central axis to the manifold bottom, said manifold waste channel adapted to engage a base unit front opening for draining used fluid into the base unit interior;

two spray nozzles attached to the manifold interior surface, one on each side of the central axis.

4. A self-contained eye wash station as recited in claim 3, further comprising:

a base unit front fastener fixedly attached adjacent the base unit top between the front apertures, said base unit front fastener adapted for releasable engagement with the manifold interior surface fastener;

two nozzle covers attached to the base unit front adjacent the base unit top between the front apertures, one cover being attached on each side of the base unit front fastener, said nozzle covers adapted for releasable engagement with the spray nozzles.

5. A self-contained eye wash station as recited in claim 4, further comprising:

a waste fluid collection container having a top, a bottom, a front, a rear and two opposite sides, said top, bottom, front, rear and opposite sides defining a collection container interior, said collection container having a spigot in fluid engagement with the collection container interior, said spigot being positioned in the collection container front adjacent the collection container bottom;

wherein said eye wash station base unit bottom is adapted to sit on the collection container top;

a fluid tube interconnecting the base unit interior with the collection container interior.

6. A self-contained eye wash station as recited in claim 5, wherein:

each reservoir container rear has a vertical handle thereon;

each reservoir container bottom has a refill opening formed therein near to the reservoir container rear, said refill opening being releasably sealable with a cap.

7. A self-contained eye wash station as recited in claim 6, wherein:

the nozzle covers are engaged with the spray nozzles when the manifold is in the closed position; and the nozzle covers are disengaged from the spray nozzles when the manifold is pivoted into the open position.

* * * * *